US009010162B2

(12) United States Patent
Thyn

(10) Patent No.: US 9,010,162 B2
(45) Date of Patent: Apr. 21, 2015

(54) RETRACTABLE KEY STORAGE APPARATUS WITH ORIGINAL KEY ADAPTOR

(71) Applicant: Rudi A Thyn, Miami, FL (US)

(72) Inventor: Rudi A Thyn, Miami, FL (US)

( * ) Notice: Subject to any disclaimer, the term of this patent is extended or adjusted under 35 U.S.C. 154(b) by 0 days.

(21) Appl. No.: 13/679,239

(22) Filed: Nov. 16, 2012

(65) Prior Publication Data

US 2013/0308300 A1 Nov. 21, 2013

Related U.S. Application Data

(60) Provisional application No. 61/561,033, filed on Nov. 17, 2011, provisional application No. 61/564,625, filed on Nov. 29, 2011.

(51) Int. Cl.

| | |
|---|---|
| ***E05B 19/04*** | (2006.01) |
| ***A44B 15/00*** | (2006.01) |
| ***A45C 11/32*** | (2006.01) |
| ***A45C 15/00*** | (2006.01) |
| ***A45C 15/06*** | (2006.01) |

(52) U.S. Cl.

CPC ..... *A45C 11/324* (2013.01); *A45C 11/326* (2013.01); *A45C 15/00* (2013.01); *A45C 15/06* (2013.01)

(58) Field of Classification Search

USPC ..... 70/456 R, 456 B, 459, 460

See application file for complete search history.

(56) References Cited

U.S. PATENT DOCUMENTS

| | | | | |
|---|---|---|---|---|
| 2,402,347 | A * | 6/1946 | Rotheraine | 70/456 R |
| 4,045,984 | A * | 9/1977 | McDonald | 70/456 R |
| 4,660,397 | A * | 4/1987 | Girimont | 70/456 R |
| 5,117,666 | A * | 6/1992 | Keefer | 70/456 R |
| 5,495,942 | A * | 3/1996 | Izhak | 70/456 R |
| 5,943,889 | A * | 8/1999 | Chiu | 70/456 R |
| 6,705,141 | B1 * | 3/2004 | Jacob et al. | 70/456 R |
| 6,892,558 | B2 * | 5/2005 | Chodosh | 70/456 R |
| 7,055,352 | B2 | 6/2006 | Meyerson et al. | |
| 7,127,922 | B2 * | 10/2006 | Khounsombath et al. | 70/456 R |
| 7,578,154 | B2 | 8/2009 | Beresnitzky | |
| 2005/0103070 | A1 | 5/2005 | Meyerson et al. | |
| 2008/0196462 | A1 | 8/2008 | Beresnitzky | |

FOREIGN PATENT DOCUMENTS

| | | | |
|---|---|---|---|
| JP | 2009-002028 | A | 1/2009 |
| JP | 2011-202448 | A | 10/2011 |
| KR | 10-2003-0088242 | A | 11/2003 |

OTHER PUBLICATIONS

Soo Hwan Jung, International Search Report and Written Opinion of the International Search Authority for PCT International Application No. PCT/US2012/065560.

* cited by examiner

*Primary Examiner* — Christopher Boswell

(74) *Attorney, Agent, or Firm* — Lott & Fischer, PL

(57) ABSTRACT

The invention provides an apparatus to retractably store multiple keys. The apparatus is designed to permit a user to install up to eight (8) custom keys in a compact "key wallet." Individual keys are pivotally deployed by pressing a designated button on the apparatus and are returned to a stowed position by rotating the key back into the apparatus until it locks into position. The apparatus uses a spring-loaded key release mechanism to release and retract the keys.

5 Claims, 15 Drawing Sheets

RETRACTABLE KEY STORAGE APPARATUS WITH ORIGINAL KEY ADAPTOR

STATEMENT OF PRIORITY

This application is being filed as a nonprovisional application under 35 U.S.C. §111(a) and 37 CFR §1.53(b) claiming priority to provisional application No. 61/561,033 filed on Nov. 17, 2011 and provisional application No. 61/564,625 filed on Nov. 29, 2011.

FIELD OF INVENTION

The invention relates generally to key storage devices and in particular to an apparatus to retractably store multiple keys. The apparatus is designed to permit a user to install up to eight (8) custom keys in a compact "key wallet." Individual keys are deployed by pressing a designated button on the apparatus and are returned to a stowed position by rotating the key back into the apparatus until it locks into position.

BACKGROUND OF THE INVENTION

Key storage devices are known. Some known key storage apparatus include keys that are retractable or that pivot out of a case. However, typically these key storage apparatus are bulky and only contain one key. Generally, these keys are for automobiles and include several other buttons and mechanisms on the key fob, resulting in a bulky storage apparatus which only stores one designated key.

Some key storage devices store multiple keys. Some key storage devices even incorporate a pivoting key, however, none of these key storage devices utilize a retaining pin/spring arrangement. Moreover, none of the known key storage devices use an adapter that enables the installation of multiple standard or original keys in the storage apparatus.

Therefore, there is a need in the art for a compact, convenient, easy to use and attractive key storage device that is capable of being loaded by its user with standard keys for easy use and organization of same. There is also a need for a compact, flat device that will not damage fabric, such as a person's pants or purse as will happen when loose keys are carried on a regular key chain.

There is a further need in the art for an apparatus that allows users to conveniently store, carry and use household and other common keys (e.g. keys for locks, auto, safe boxes, and the like) in a device that organizes the keys and can conveniently deploy a specific, user-selected key at the push of a button.

SUMMARY OF THE INVENTION

The apparatus of the present invention is a multi-key storage and individual key spring ejection case hereinafter referred to as the "JJETT KEY". The JJETT KEY is a two-sided multi-key storage and individual key spring ejection apparatus equipped with a flashlight capable of illuminating each end of the JJETT KEY. In a smaller, slimmer version, the JJETT KEY is capable of housing up to four (4) individual keys and in a larger version the JJETT KEY stores up to eight (8) keys. In the eight key apparatus, each side contains four (4) keys.

The JJETT KEY includes customized industry-standard key "blanks" that are capable of being easily removed in order to have each cut to a desired existing key and then inserted back into the JJETT KEY for easy access and use. Each JJETT KEY customized key is individually released from a locked position by depressing a release button spring mechanism built into the JJETT KEY. The released individual JJETT KEY customized key automatically swivels 180 degrees with aid of an internal spring mechanism into a locked horizontal position for use.

Once deployed, a key is retracted into the case by depressing the "key release" button and manually folding the key into the JJETT KEY case until it locks into the closed position.

The JJETT KEY's flashlight can be activated by depressing the flashlight button located in the center of each side of the JJETT KEY and the individual connected industry manufactured bulb or LED located at each center end of the JJETT KEY will illuminate as powered by an industry-standard compact battery (e.g. CR 2025). The JJETT KEY case may be manufactured from custom molded plastic and metal parts, and constructed and assembled from industry standard materials such as plastic, rubber, metal, alloys, washers, screws, nuts, springs, wiring (copper, aluminum, etc.).

The JJETT KEY apparatus is assembled from multiple "plate" components, including two external "cover plates", two internal "key plates" and one internal "middle plate". The cover plates are located on the outside of the apparatus and generally form the housing. Each cover plate has openings for deployment buttons for up to four (4) keys. Each cover plate also includes a central button used to activate an LED flashlight located in the middle plate. The inner portion of each cover plate also includes a semi-circular groove and pin lock orifice for guiding and locking the rotation of a key release button (also referred to hereinafter as a retaining pin) which holds each of the keys in place. The key release buttons include a protruding guide pin which rides on the groove. The key release button is also equipped with an inner spring that rotates the attached key into the deployed position when the guide pin is depressed to release it front the pin lock orifice. The key release button and inner spring are anchored in openings located on the middle plate. The key release buttons are inserted through opening in the key plates where the keys themselves are also installed. In some embodiments, the apparatus is adapted to equip only specially designed keys that have the correct geometry to permit insertion of the key release buttons and guide pins. In other embodiments, an adapter is included that permits a standard key to be inserted in the apparatus.

Although the invention is illustrated and described herein in reference to a specific embodiment, it is nevertheless not intended to be limited to only the details shown, since various modifications and structural changes may be made therein without departing from the spirit of the invention and within the scope and range of equivalents of the claims. The construction of the invention, however, together with additional objects, features, and advantages thereof will be best understood and appreciated from the following detailed description of the embodiments thereof, selected for purposes of illustration and shown in the accompanying drawings.

DETAILED DESCRIPTION

Figure 1:
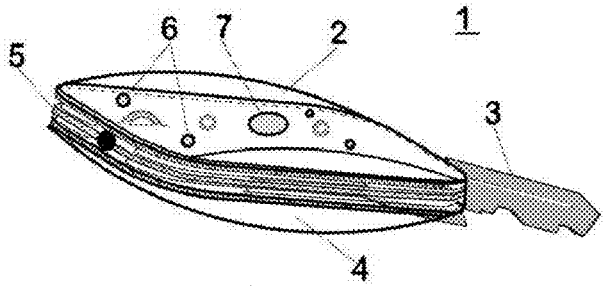
FIG. 1 is an overall top and side perspective plan view of the JJETT KEY.
Figure 2:
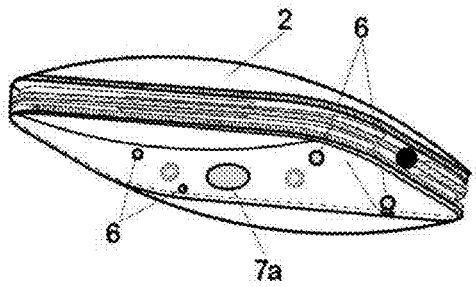
FIG. 2 is an overall bottom and side perspective plan view of the JJETT KEY.
Figure 3:
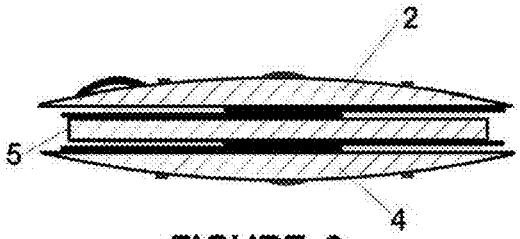
FIG. 3 is a side perspective view of the JJETT KEY.
Figure 4:
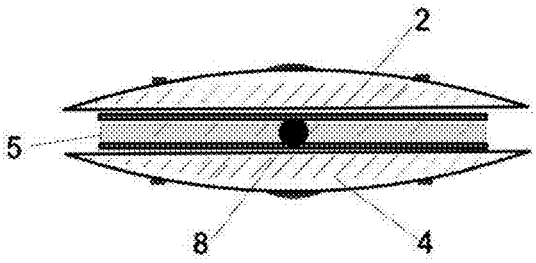
FIG. 4 is a front perspective view of the JJETT KEY.

Embodiments of the invention are illustrated in the accompanying drawings. The present invention can be best understood by referring to the enclosed drawings and the following explanation.

The JJETT KEY casing or housing is assembled primarily and basically from five (5) individual proprietary custom designed molded manufactured plastic plates referred to and illustrated in the attached drawing sheets.

FIGS. 1, 2, 3 and 4 depict the top, bottom, side, frontal perspective plan views of the JJETT KEY. The JJETT KEY 1 apparatus is assembled from multiple "plate" components, including two external cover plates 2 and 4, two internal key plates and one internal middle plate 5. The cover plates 2 and 4 are located on the outside of the apparatus 1 and generally form the housing. Each cover plate 2 and 4 has openings for four (4) spring-loaded key release mechanism buttons 6 (also known herein as key release buttons) for up to four (4) keys. Each cover plate 2 and 4 also includes a central button 7 and 7*d* respectively used to activate an LED flashlight 8 located in the middle plate 5.

Figure 5:
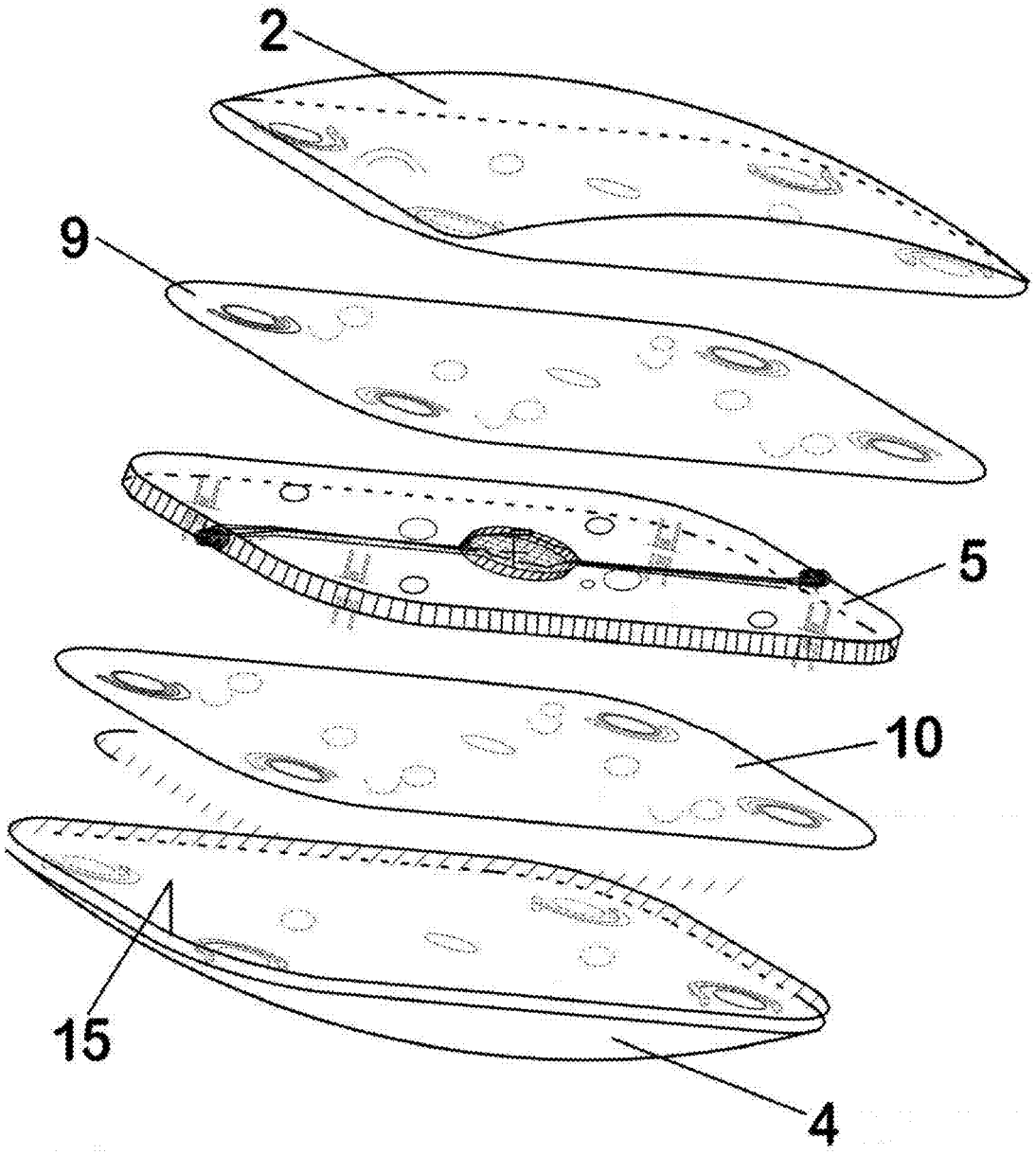
FIG. 5 is an exploded view of the JJETT KEY.
Figure 6:
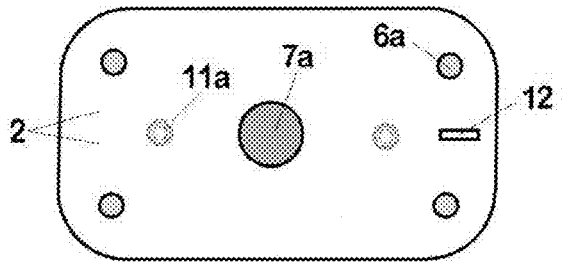
FIG. 6 is a top plan view of the top cover plate A of the JJETT KEY.
Figure 7:
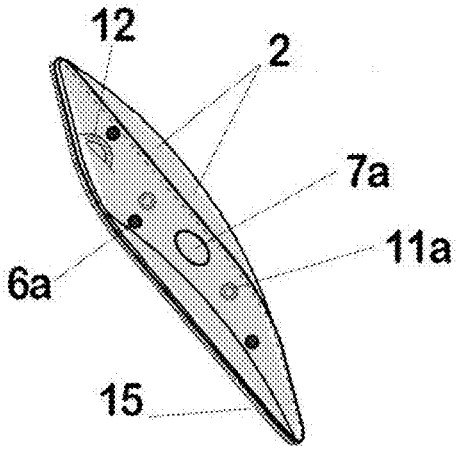
FIG. 7 is an angle perspective plan view of the top cover plate A of the JJETT KEY.

FIG. 5 depicts an exploded view of the JJETT KEY 1 illustrating how all the main JJETT KEY plates fit together. First is the cover plate A 2. Directly below cover plate A 2 is key plate A 9. In the middle is the middle plate 5, followed by key plate B 10, then cover plate B 4. Detailed illustrations and descriptions of each plate are as follows:

Cover plate A—See FIGS. 6-9 for details.

Figure 10:
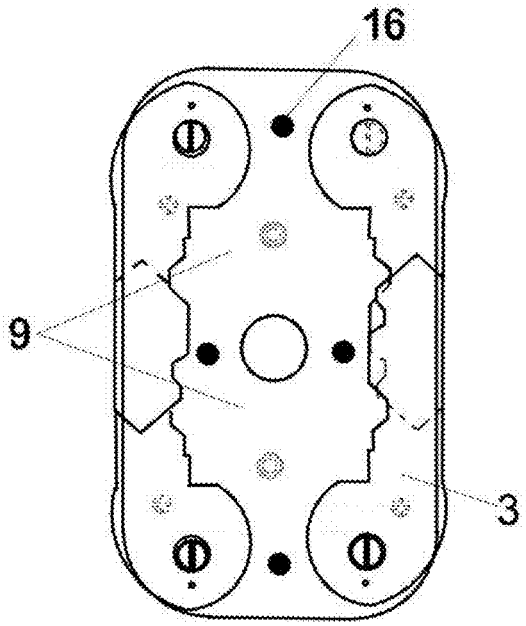
FIG. 10 is a top plan view of the topside of key plate A.
Figure 12:
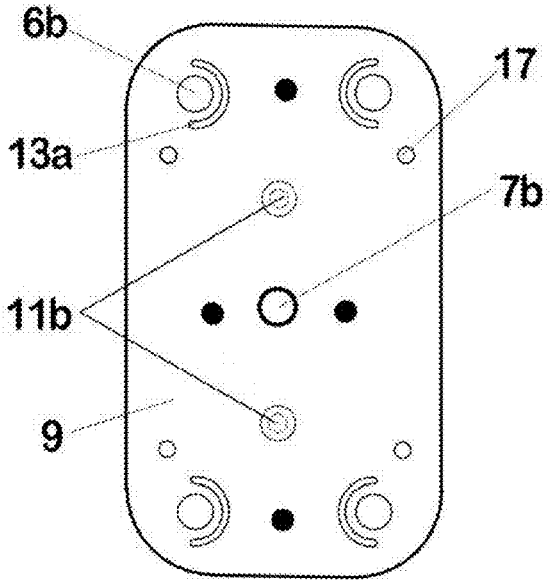
FIG. 12 is an underside plan view of key plate A.

Key plate A—See FIGS. 10 and 12 for details.

Middle plate—See FIGS. 14-18 for details.

Figure 11:
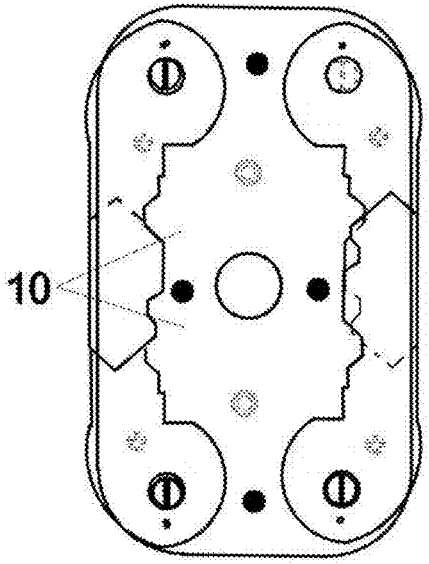
FIG. 11 is a top plan view of the topside of key plate B.
Figure 13:
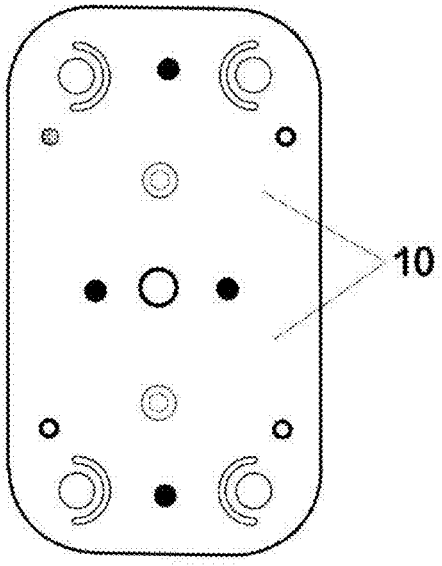
FIG. 13 is an underside plan view of key plate B.

Key plate B—See FIGS. 11 and 13 for details.

Cover plate B—See FIGS. 19-23 for details.

Figure 8:
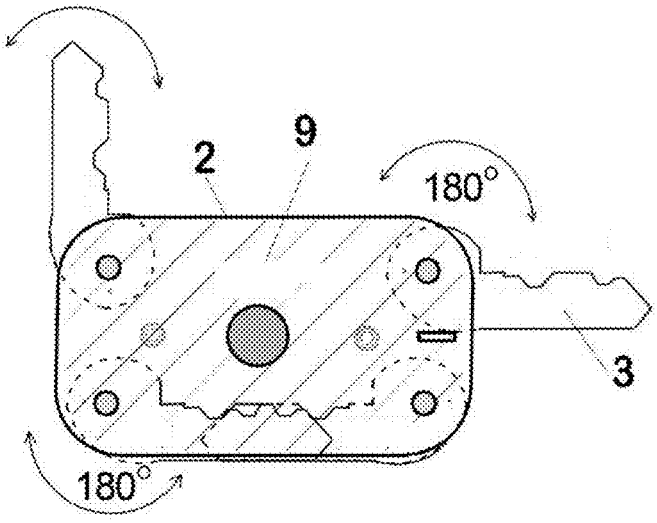
FIG. 8 is a conceptual "see through" plan view of the top cover plate A to key plate A and keys.
Figure 9:
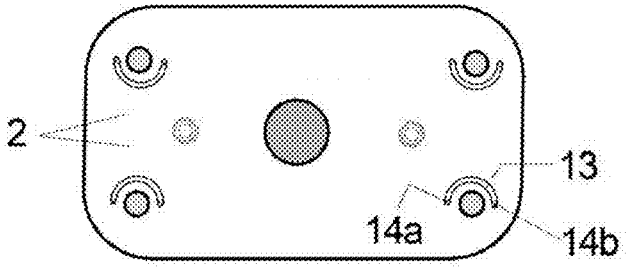
FIG. 9 is a underside plan view of the underside of the cover plate A.

FIGS. 6-9 depict the cover plate A 2 of the JJETT KEY 1. These figures detail the topside and underside plan views, angle perspective and conceptual "see through" plan views of cover plate A 2. Cover plate A 2 is shown as a plastic domed molded case cover. Two attachment hex screw openings 11*a* are located in cover plate A 2 to allow for removal and fastening of the cover plate A 2 so as to access keys placed on key plate A 9. Located in the center of cover plate A 2 is one flashlight on and off button contact switch opening 7*a*. The cover plate A 2 also includes four spring key release mechanism button openings 6*a*. On one end of the cover plate A 2, there is a molded key ring fastener (for key chain, etc.) loop 12. Cover plate A 2 contains an edge piece 15 on each of its longer sides, which serves to overlap, encase and seal internal plates. FIG. 9 shows the underside of cover plate A 2 with a view of openings and grooves found thereon. There are four guide ½ circle curve grooves 13 for the key release button 6. There is one small hole 14*a* and 14*b* at each end of each ½ circle guide groove 13 to lock key release guide pin 6*c* and thereby the key 3.

As shown in FIG. 8, when released from its locked position within the JJETT KEY 1 housing, by depressing the release mechanism button 6, the customized key 3 ejects and swivels 180° to its open and locked position for use. In order to return the key 3 into its original locked position within the JJETT KEY 1 housing, the release mechanism button 6 must be depressed and the key 3 manually folded back into the JJETT KEY 1 housing until it locks into the closed position.

FIGS. 10-13 depict the two key plates—key plates "A" and "B", unto which the keys are set. FIGS. 10 and 12 illustrate the top and underside plan views of key plate A 9 and FIGS. 11 and 13 illustrate the top and underside plan views of key plate B 10. Key plate A 9 and key plate B 10 can be plastic molded casing key plates. On both key plates A 9 and B 10, there are four (4) molded raised spacers 16 to allow free movement of key release mechanism button 6 and customized JJETT keys 3. There are four (4) holes or openings 6*b* for key release mechanism buttons 6. There are four (4) curved ½ circle openings 13*a* for key release mechanism button guide pin 6*c*. There are four (4) pass through screw holes 17 to fasten key plate A 9 and key plate B 10 onto the middle plate 5 top and underside respectively. Key plates A 9 and B 10 also include one (1) central hole 7*b* to secure and pass through flashlight on and off button 7 and wiring/contact. There are also two (2) pass through holes 11*b* for cover plates A 2 and B 4 hex screw fastening.

Figure 14:
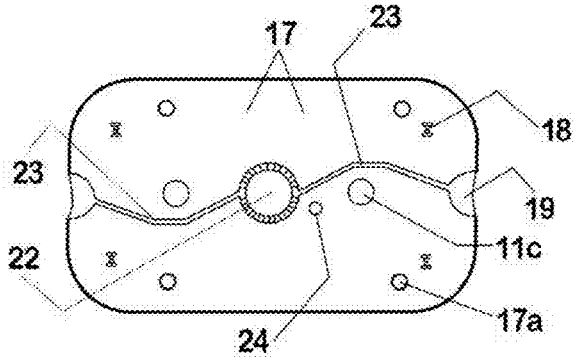
FIG. 14 is a top plan view of the topside of the mid plate.
Figure 15:
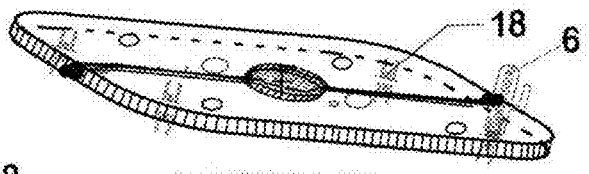
FIG. 15 is a perspective plan view of the mid plate.
Figure 16:
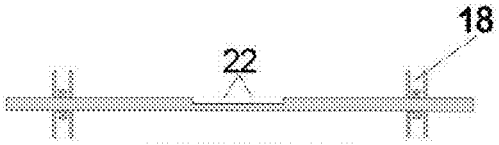
FIG. 16 is a side view plan of the mid plate.
Figure 17:
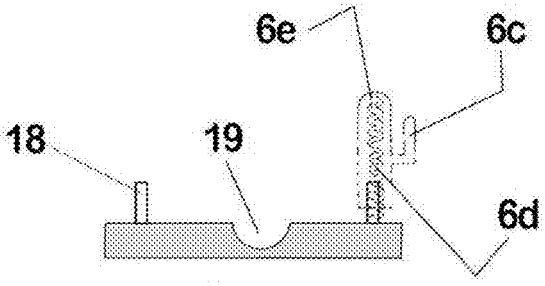
FIG. 17 is a side view plan of the front of the mid plate.
Figure 18:
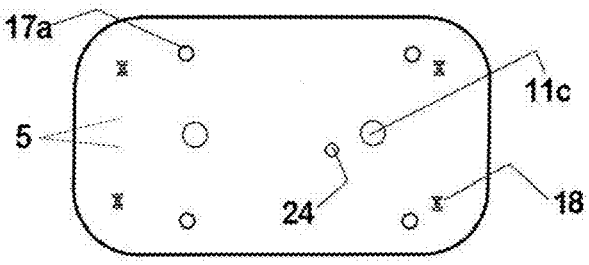
FIG. 18 is an underside plan view of the underside of the mid plate.
Figure 19:
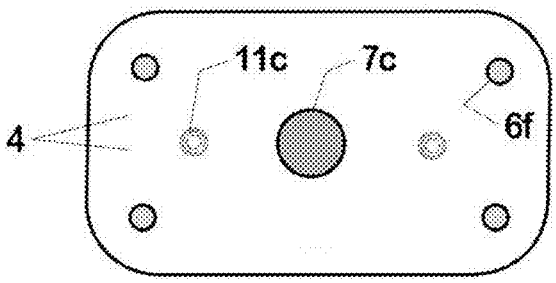
FIG. 19 is a top plan view of cover plate B.
Figure 20:
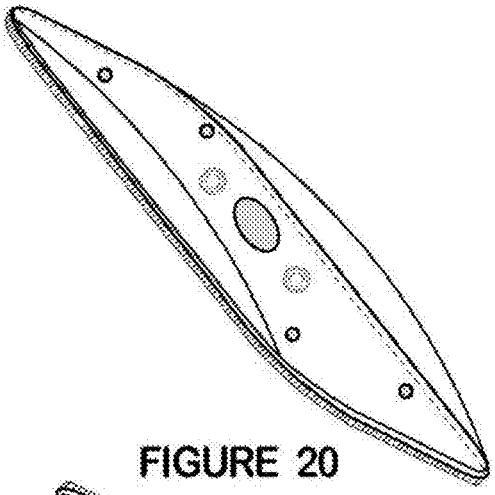
FIG. 20 is a perspective top plan view of cover plate B.
Figure 21:
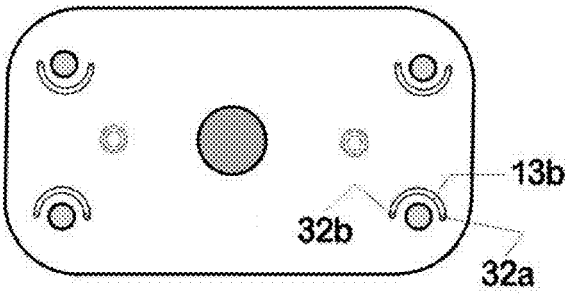
FIG. 21 is an underside plan view of the underside of cover plate B.
Figure 22:
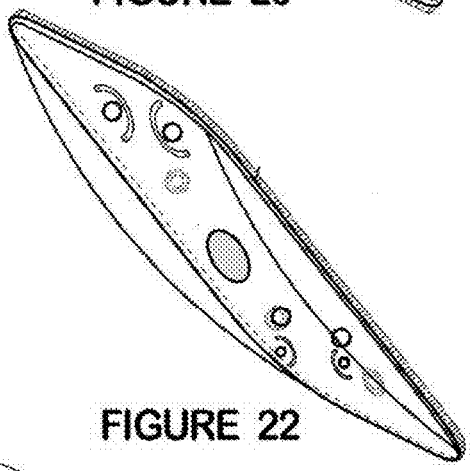
FIG. 22 is a perspective underside plan view of cover plate B.
Figure 23:
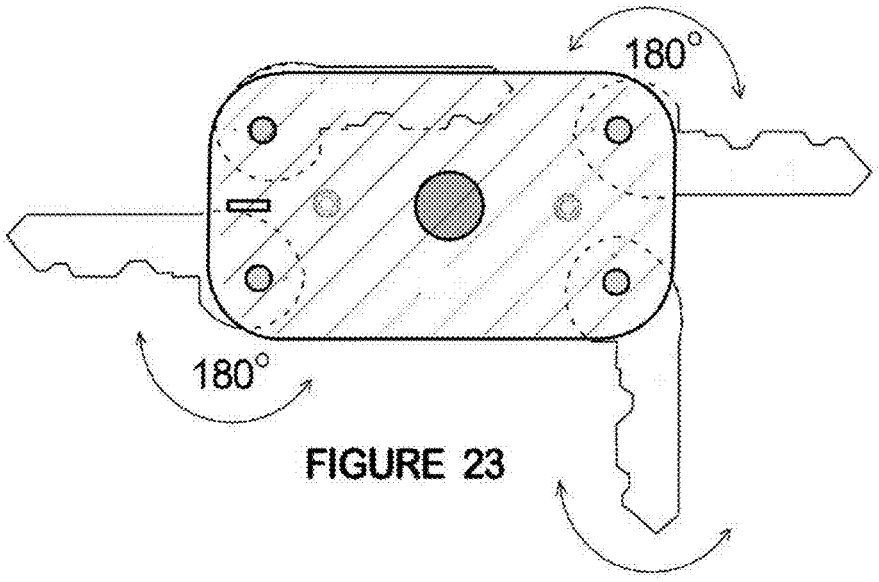
FIG. 23 is a conceptual "see through" plan view of the top cover plate B to key plate B and keys.

FIGS. 14-18 depict the top and underside of the middle plate 5. The middle plate 5 is the center of the JJETT KEY assembly 1 and contains the flashlight wiring, bulb bases, screw anchor mounts, as well as, the release mechanism coil spring molded anchors. The middle plate 5 is shown as having a topside and underside, and they differ from each other. The top side and angled perspective plan views are illustrated in FIGS. 14 and 15, the middle plate's 5 frontal and side plan views are illustrated in FIGS. 16 and 17, and the middle plate's 5 underside plan view is shown in FIG. 18. The middle plate 5 is shown as a plastic molded plate. There are four identical plastic molded coil spring anchors 18 on each the top and underside of the middle plate 5. There is one molded light bulb saddle 19 at each end of the middle plate 5. There are two threaded screw mounts lie for hex screw fasteners for both cover plates A 2 and B 4 to middle plate 5 topside and underside. There are four (4) threaded screw mounts 17*a* for fasteners of both key plates A 9 and B 10 to the middle plate 5 topside and underside.

On the topside of middle plate 5, there is one battery housing 22. The battery housing 22 is not an opening. The battery sets into the molded "saddle" containing the contact wiring grooves 23 to the bulbs. The light bulb power wiring is seated in a contact groove 23 to each bulb. The middle plate 5 also includes one opening 24 for flashlight wiring/contact to pass through to the cover plate B 4. There are eight (8) identical key release buttons 6 with guide and release pin 6*c*, internal coiled and tensioned springs 6*d* anchored 6*e* within the release button assembly. FIG. 18 illustrates the underside of the middle plate 5. The lighting battery saddle 22, wiring grooves 23 and bulb saddles 19 are not on the underside of the middle plate 5, rather they are only found on the top side of the middle plate 5.

FIGS. 19-23 depict the top, underside, angled perspective, and see through plan views of cover plate B 4. There are two (2) attachment hex screw openings 11*c* to remove and fasten the cover plate B 4 so as to access keys 3 placed on key plate B 10. There is one flashlight on and off button contact switch opening 7*c*. There are four (4) spring key release button openings of for keys on key plate B 10. Cover plate B 4 also includes four (4) guide ½ circle curve grooves 13*b* for key release guide pin 6*c*. There is one (1) small hole 32*a* and 32*b* at each end of each guide ½ circle groove 13*b* to lock key release guide pin 6*c* and thereby the key 3.

Figure 24:
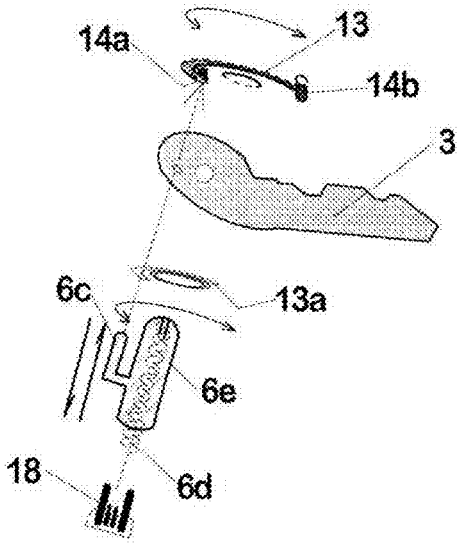
FIG. 24 is an exploded plan showing the key release mechanism.
Figure 25:
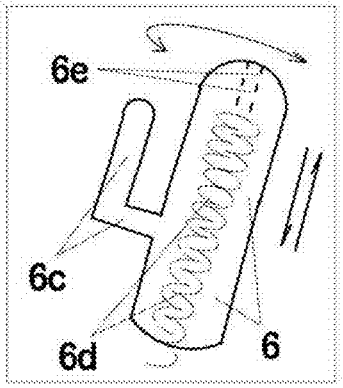
FIG. 25 is a detailed view of the key release mechanism.
Figure 26:
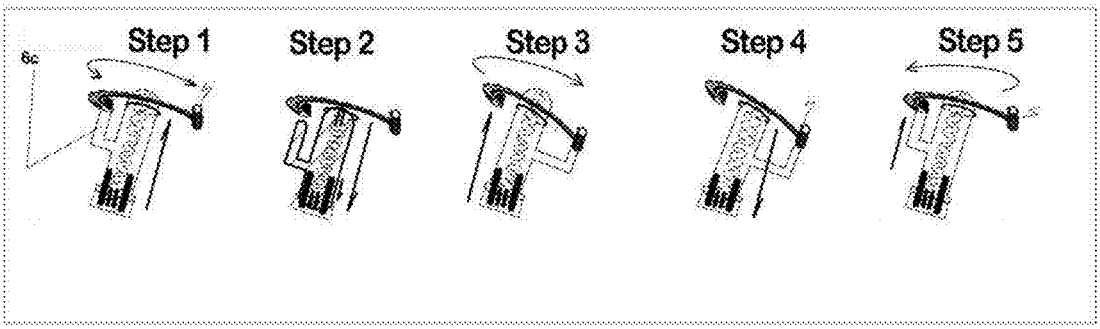
FIG. 26 is a step by step view of the key release motion detail.

FIGS. 24, 25 and 26 depict the key release button 6 assembly and motion concept. This mechanism is a custom molded item that when depressed releases and automatically swivels a key 3 into the open and locked position for use. The key release button 6 is secured and guided through the guide pin 6*c* which is fitted into the cover plate A 2 and cover plate B 4 ½ circle guide grooves 13 and 13*b*. The key release button 6 (also referred to as retaining pin) is hollow so that it houses a coiled and tensioned spring 6*d* anchored 18 within so that the spring 6*d* is tensioned when turned up to 180° and swivels to its original positioned (open) when released. The coiled spring also causes the release button 6 to move vertically and automatically springs back into position after it has been manually depressed.

The key release button 6 is designed for manual depression to unlock it from its closed position. Once depressed, the tensioned spring 6*d* forces the key release button 6 and thus the attached key 3 to swivel up to 180°. The key release button guide pin 6*c* swivels within the restraints of the ½ circle (180°) guide grooves 13 and 13*b* until it reaches the end of the grooves 13 and 13*b* where pin holes (i.e. 14*a* and 14*b*) are present to allow the pin 6*c* to spring 6*d* into the hole 14*a* thus locking the mechanism and attached key 3 in place. To release the key 3 from its open and locked position the key release button 6 is depressed and the key 3 manually folded back into the JJETT KEY case 1 until the guide pin 6*c* springs into the opposite pin hole (i.e. 14*b*) and locks the key 3 into its original the closed position.

Figure 27:
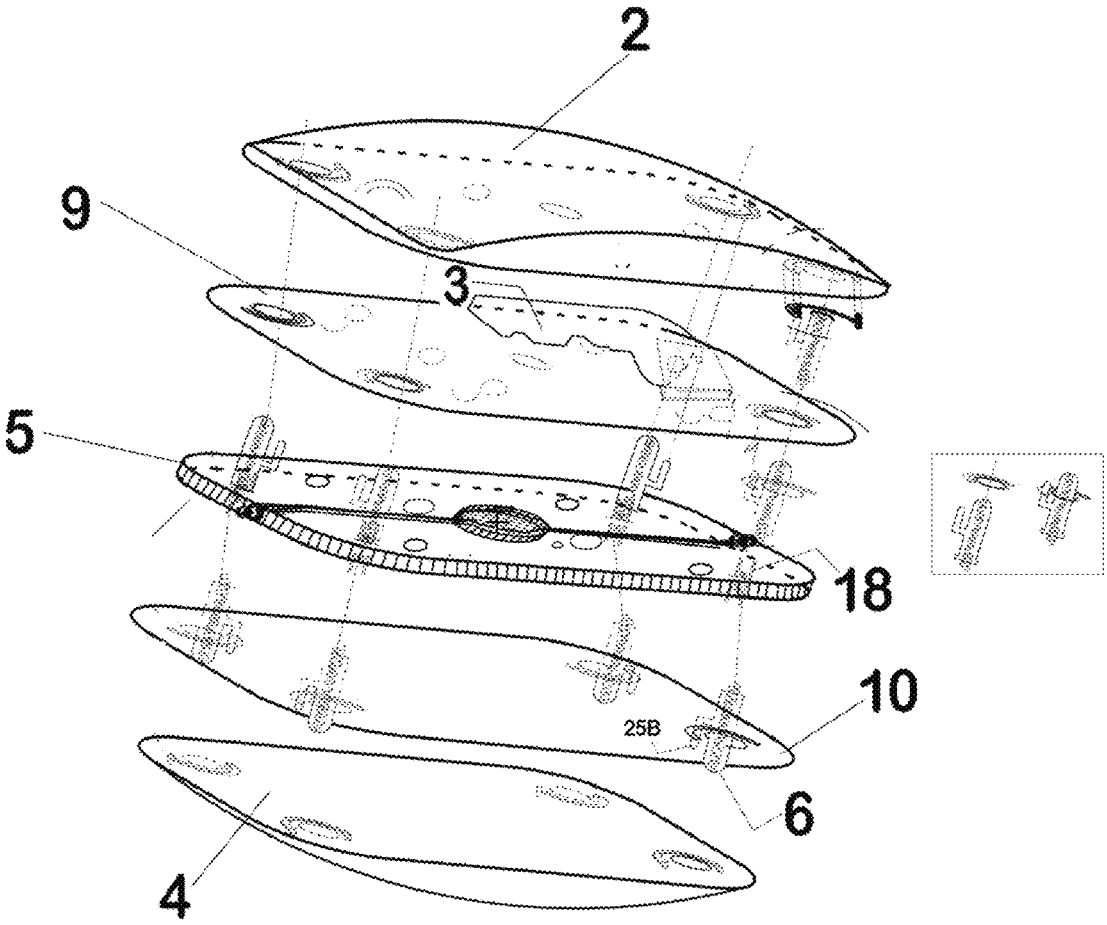
FIG. 27 is an exploded plan depicting the placement and assembly of the release button within the JJETT KEY plates.
Figure 28:
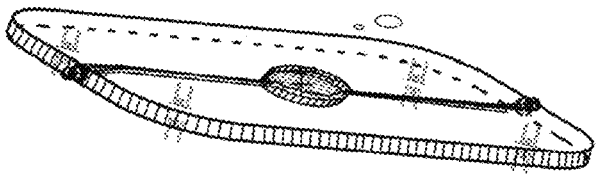
FIG. 28 is a perspective view plan of the mid plate showing the lighting assembly.
Figure 29:
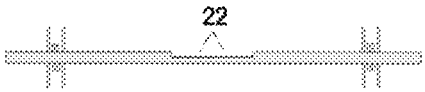
FIG. 29 is a side view of the mid plate showing the lighting assembly.

FIG. 27 depicts the placement and assembly of the key release button 6 within the JJETT KEY plates. Each key release button 6 assembly is placed on the middle plate 5, on both the topside and underside directly over the molded spring anchors 18. Once in place then they are overlain by key plate A 9 and key plate B 10. The key plates A 9 and B 10 are then secured with screws 45 (see FIG. 34) onto middle plate 5. After the key plates A 9 and B 10 are secured in place then the keys 3 are placed over and onto the key release button 6 and guide pin 6*c*. Once the keys 3 have been placed into position then they are overlain with cover plates A 2 and B 4. The cover plate A 2 and cover plate B 4 are secured to the middle plate 5 with hex screws 44 (see FIG. 34) that pass through key plate A 9 and key plate B 10.

Figure 30:
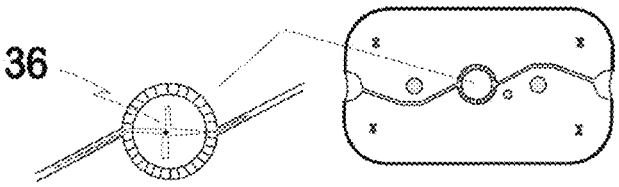
FIG. 30 is a top plan view of the topside of the mid plate with the lighting assembly.
Figure 31:
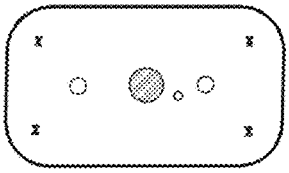
FIG. 31 is an underside plan view of the underside of the mid plate with the lighting assembly.
Figure 32:
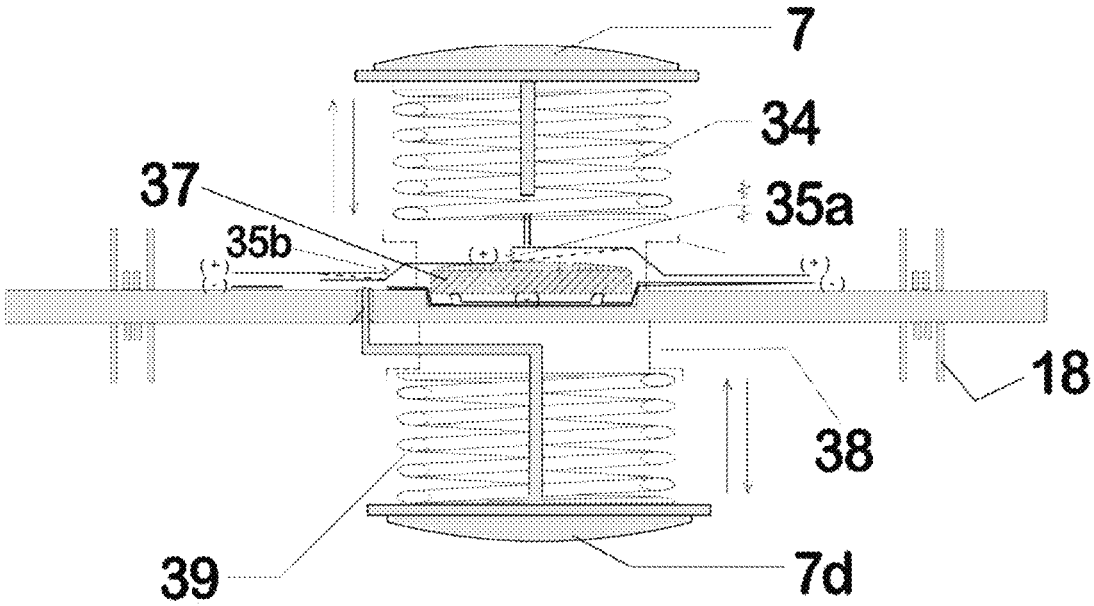
FIG. 32 is a detailed side view of the lighting assembly.

FIGS. 28-32 depict the JJETT KEY 1 lighting or flashlight contact assembly. FIG. 32 shows the lighting contact in detail. The on and off button 7 activates the light and is located on cover plate A 2. Located on the topside is a top coil spring 34. The lighting contact assembly also includes metal strip contacts for the topside 35*a* and for the underside 35*b*. Shown in FIG. 30 is battery housing metal contacts 36. As shown in FIG. 32, the lighting contact assembly uses a typical button battery 37, for example, a CR 2025-3V battery. Located on the underside is a underside coil spring 39. The coil springs 34 and 39 are seated in a coil spring housing 38 on both the topside and the underside. The underside lighting on and off button 7*d* is located within cover plate B 4.

Figure 33:
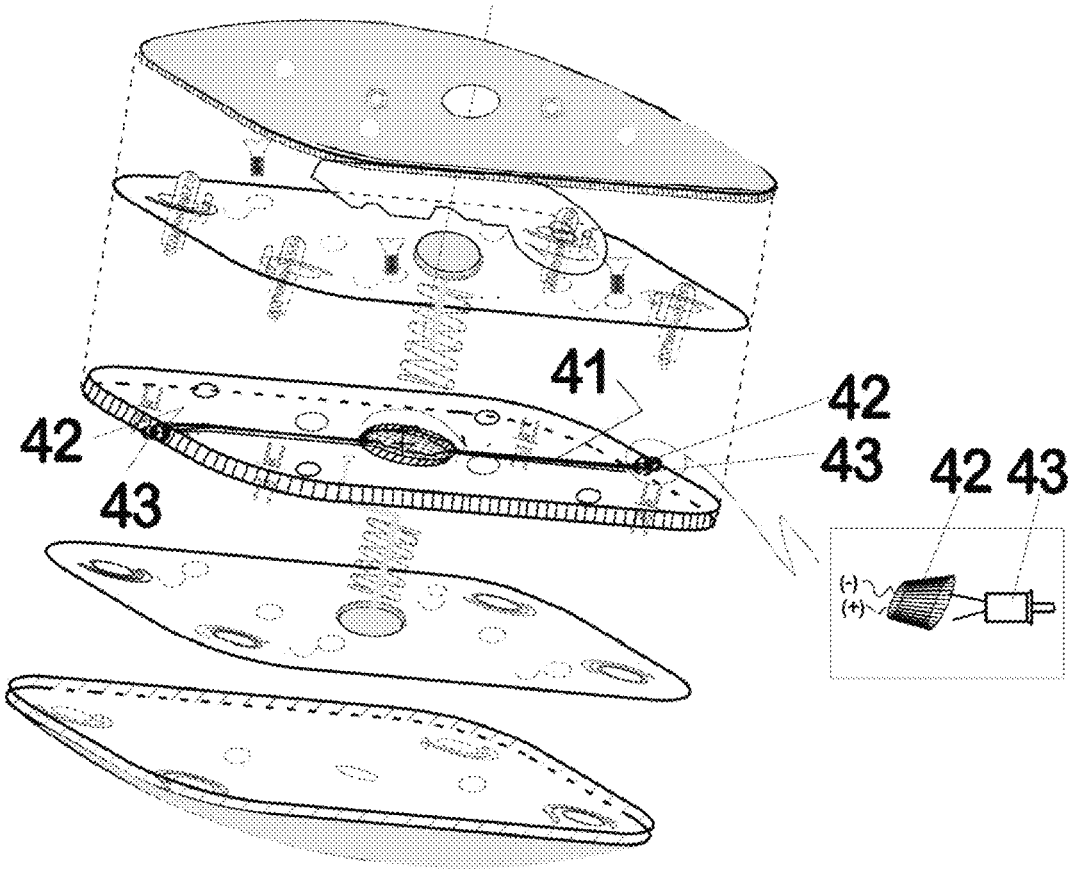
FIG. 33 is an exploded view of JJETT KEY, lighting assembly and bulb housing.

FIG. 33 is an exploded view of JJETT KEY 1, lighting assembly and bulb housing. FIG. 33 depicts the lighting on and off button 7 and 7*d* assemblies, as well as the battery 37 placement, wiring 41 and bulbs 43 within and throughout the JJETT KEY 1 case. LED bulbs 43 are seated at each end of the JJETT KEY 1 case and they are turned on by depressing the lighting on and off buttons 7 and 7*d* located in the centers of both cover plate A 2 and cover plate B 4. When depressed and held in place, the lighting on and off buttons 7 and 7*d* cause the metal strips 35*a* and 35*b* to contact and create power continuity to the bulbs 43 and they illuminate. When the lighting on and off buttons 7 and 7*d* are no longer depressed the coil springs 34 and 39 cause the metal strips 35*a* and 35*b* to disengage, thereby disrupting the power flow to the bulbs 43 and the light turns off. Also shown is the wiring 41 from the battery saddle 22 to the bulb saddle 19. Seated within the bulb housings 42 are LED bulbs 43. Optionally, the lighting assembly could include a timer, such that the light would automatically turn off after a set amount of time.

Figure 34:
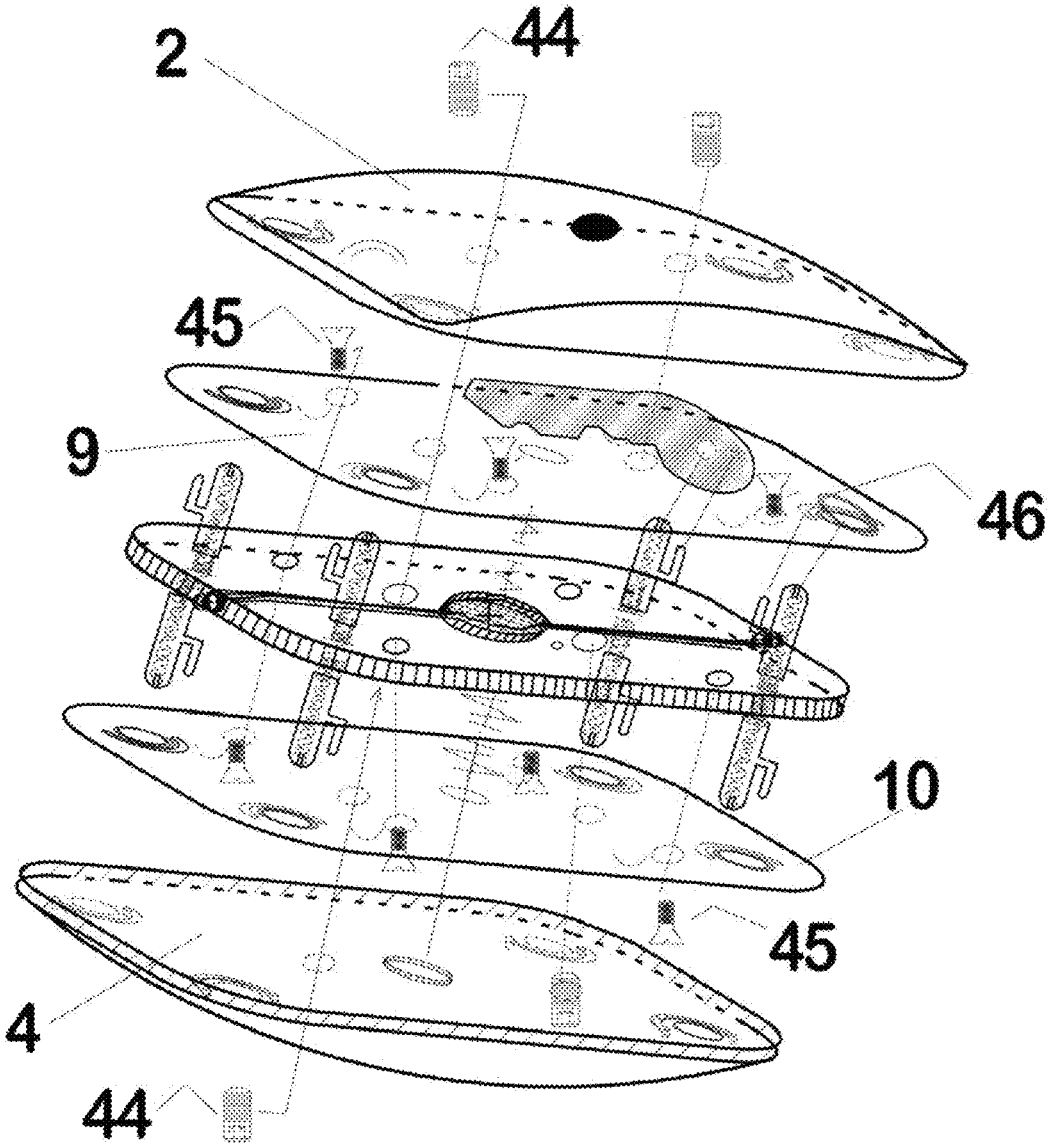
FIG. 34 is an exploded view of the JJETT KEY and the fasteners.

FIG. 34 depicts the JJETT KEY 1 plates and fasteners. There are eight (8) flush fitting Philip screws 45. Four Philip screws 45 fasten key plate A 9 into threaded holes 17*a* located in the middle plate 5 topside; and four Philip screws 45 that fasten key plate B 10 into threaded holes 17*a* located in the middle plate 5 underside. There are four hex screws 44. Two hex screws 44 fasten cover plate A 2 into threaded holes 11*c* located on the topside of the middle plate 5. The other two hex screws 44 fasten cover plate B 4 into threaded holes 11*c* located on the underside of the middle plate 5. Also shown in the JJETT KEY 1 apparatus are eight (8) frictionless industry standard washers 46. A washer 46 is used at each key location, to assist the keys 3 to swivel freely as necessary for ejection when deployed.

Figure 35:
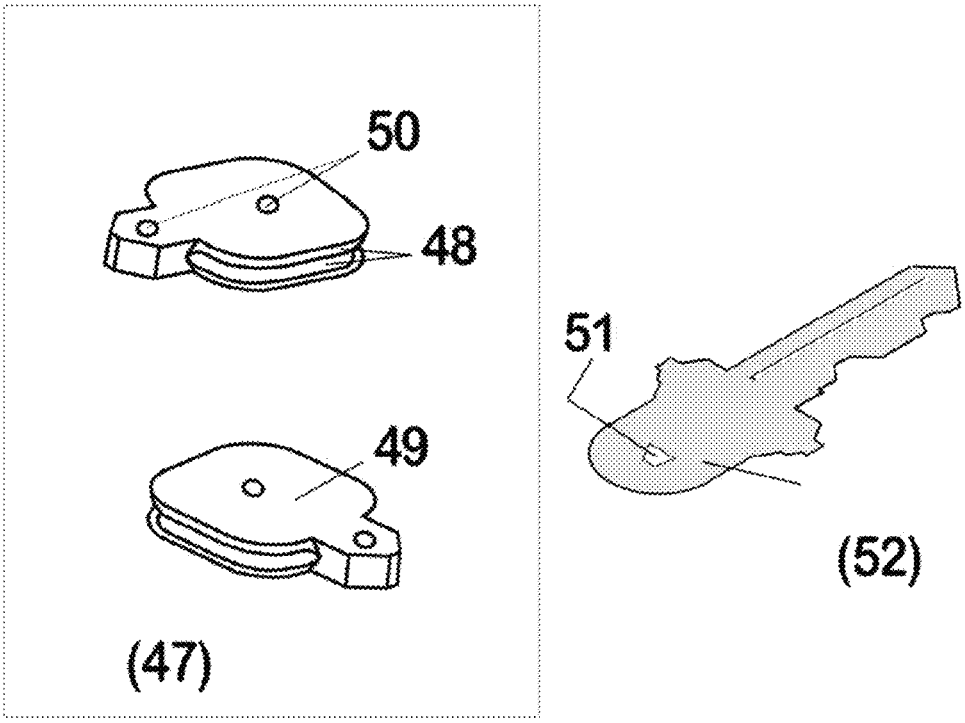
FIG. 35 is a left and right side view of the key adapter.
Figure 36:
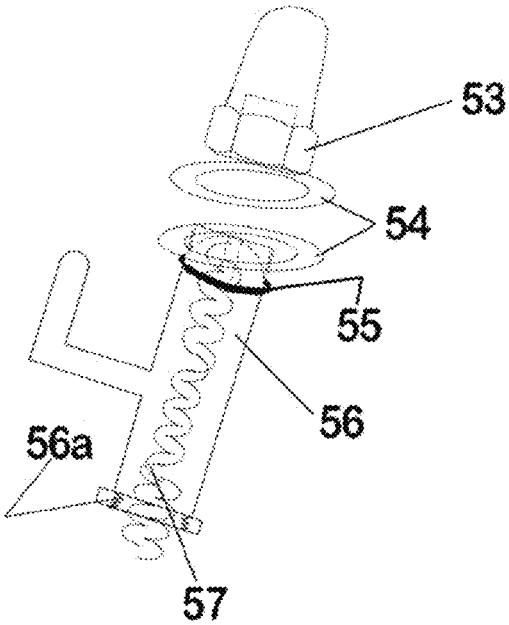
FIG. 36 is an exploded view of the key pin.
Figure 37:
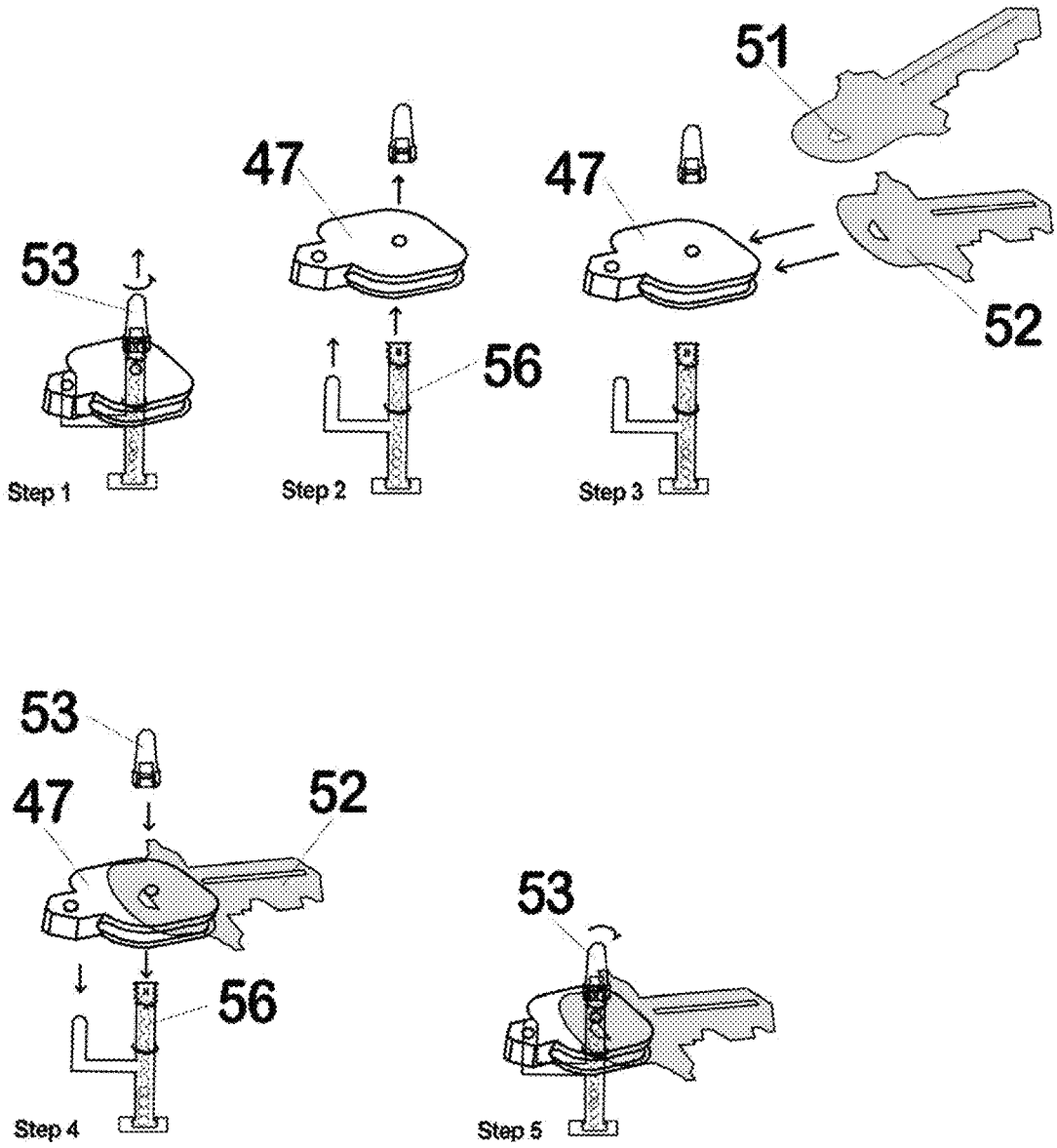
FIG. 37 is a step by step view of use of the adapter with an original key.

FIGS. 35, 36 and 37 depict an optional original key adaptor which allows the apparatus of the present invention to utilize existing keys 52 without the necessity of using a customized key blank. The original key adaptor 47 is a clam shell shaped key clamp. It is constructed of a tin or other suitable metal outer shell 49 with a rubberized inner lining 48 that contacts both key sides. The original key adaptor 47 can also be constructed of a hard plastic with a rubber washer or surround which creates enough friction to stop the key and hold it in place when deployed. The original key adaptor 47 is ridged yet flexible enough to clamp down when fastened and hold the key 52 in place restricting free movement or rotation of the key. The original key adaptor 47 is made so that an original key 52 can be easily squeezed into the clamp's jaws so that the clamp hole 50 and the key's ring hole 51 line up.

Once an original key 52 is inserted into the original key adaptor 47 it will be secured by screwing down the anchor nut 53. The original key adaptor 47 will sit on a protruding circular ridge 55 of the key pin 56 so that it cannot slide down. The tighter the anchor nut 53 is made the harder it is to rotate the key 52. A set of washers 54 on either side of the key 52 will assist to secure the key 52 in place.

An optional original key adaptor 47 set is available in order to use an original key 52 in the JJETT KEY 1 case and utilize as described above. Most typical keys 52 can be utilized without the need of the customized JJETT KEY 1. The JJETT KEY 1 case and original key adaptor 47 set are primarily constructed from molded plastic(s) and metal(s), and constructed and assembled from industry standard materials such as plastic(s), rubber(s), metal(s), alloys, washers screws, nuts, springs, wiring (copper, aluminum, etc.).

FIG. 37 provides a step by step illustration of the installation of an existing original key 52 in the original key adapter 47. In step 1, the anchor nut 53 is removed. In step 2, the adaptor clamp 47 is slid off of the key pin 56. In step 3, the original key 52 is slid into the adaptor clamp 47 and the key ring hole 51 is aligned with the adaptor hole 50. In step 4, the aligned key 52 and the adaptor clamp 47 are slid onto the key pin 56 until seated. In step 5, the anchor nut 53 is replaced back onto the key pin 56 and securely tightened.

Figure 38:
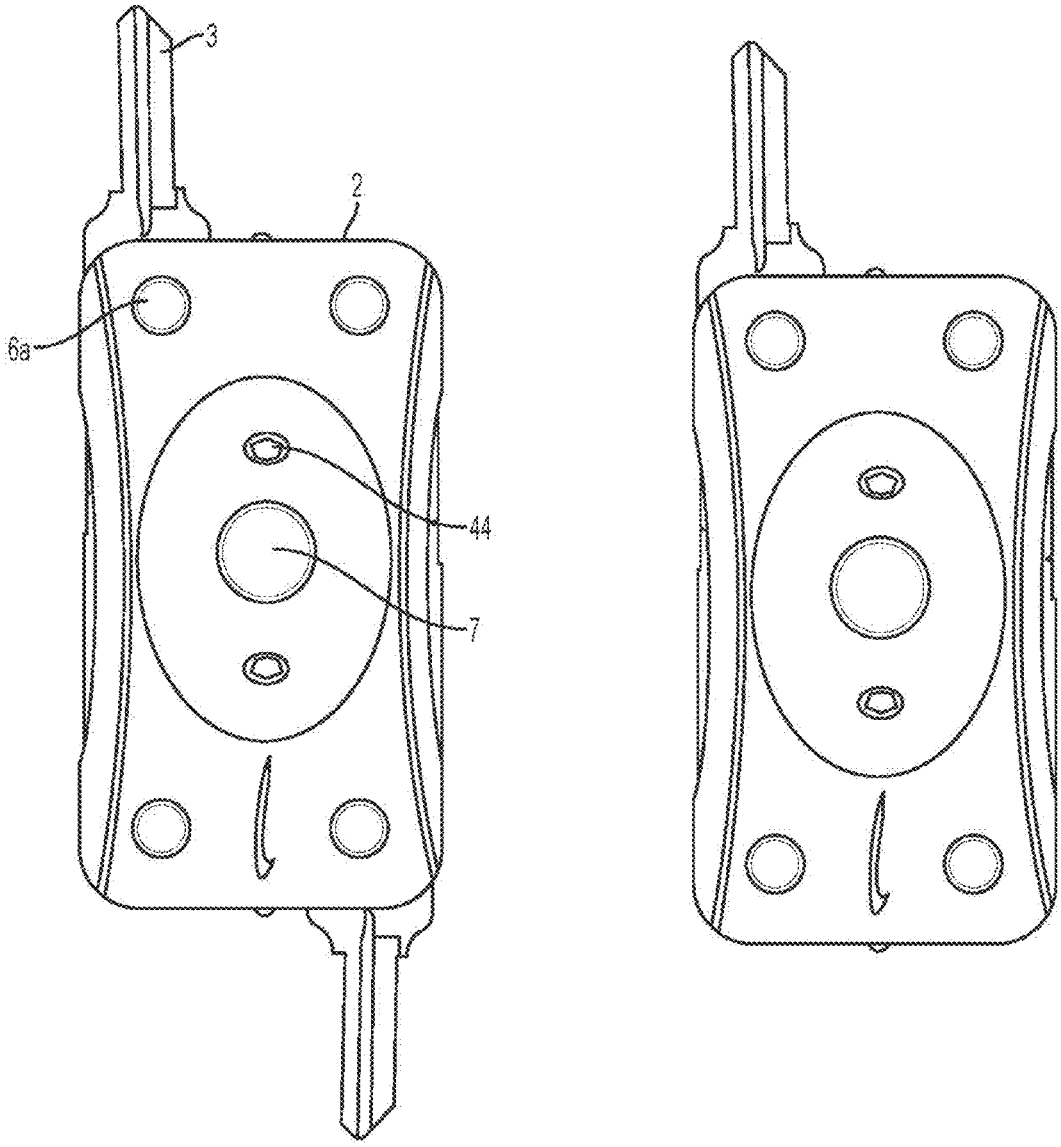
FIG. 38 is a picture of an embodiment of the JJETT KEY.
Figure 39:
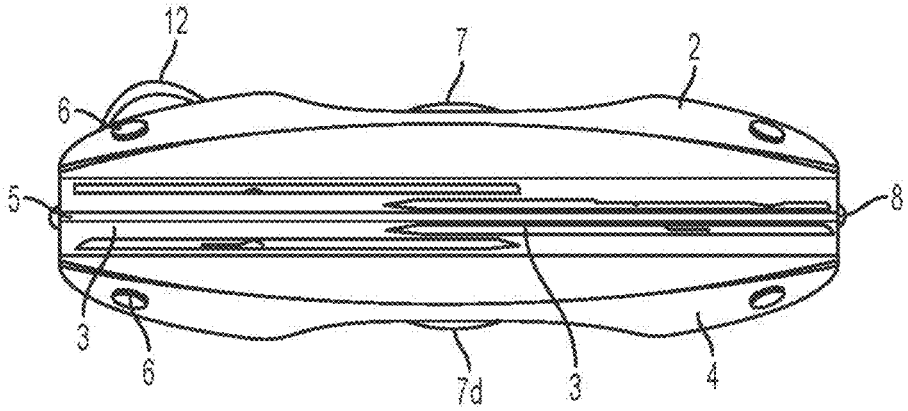
FIG. 39 is a picture of the side of an embodiment of the JJETT KEY.
Figure 39:
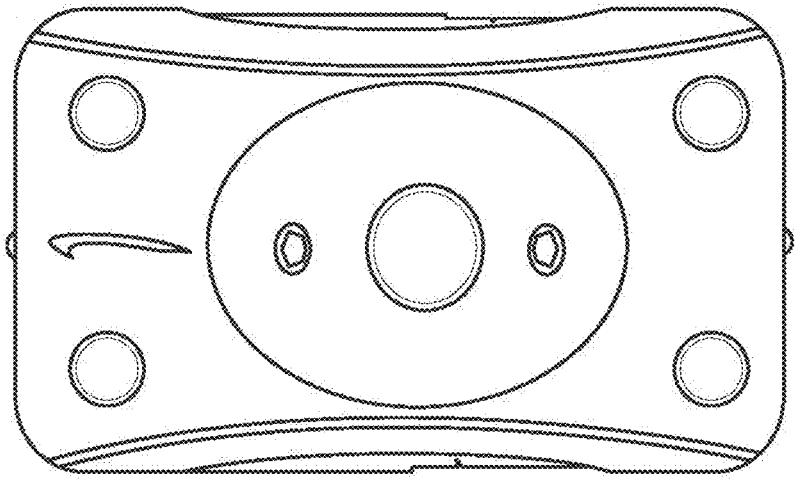

FIGS. 38 and 39 are pictures of an embodiment of the JJETT KEY 1 device. FIG. 38 shows the topside of cover plate A 2. Two keys 3 have been deployed. The JJETT KEY 1 device is composed of a black cover plate A 2 and the four key release buttons 6*a* are different colors (i.e. yellow, red, blue and green). The user can designate a particular color to a specific key 3, so that the user knows which key 3 he is deploying. Also shown are two hex screws 44 and the lighting on and off button 7. FIG. 39 is a picture of the side of an embodiment of the JJETT KEY 1. This embodiment is able to contain eight (8) keys 3. The sides of four (4) of the keys 3 are visible. The keys 3 are not deployed. This embodiment is designed to be approximately 30 mm in width. Visible in the upper cover plate A 2 are the lighting on and off button 7, the key release buttons 6, and the key ring fastener loop 12. The keys 3 surround the middle plate 5. Visible in the lower cover plate 4 are the key release buttons 6 and the lighting on and off button 7*d*.

In an alternate embodiment, other accessories may be utilized in the storage device in addition to or in place of the keys. Accessories may include a USB drive, files, openers, screwdrivers, etc. Accessories may include any desired implement that would fit in place of a key. The accessories would be deployed according to the mechanism used by the keys.

Although described above in connection with a specific embodiment, this is not meant to be limiting, as other retractable key storage apparatus and various plates can be made in accordance with the description herein. As such, although the invention is illustrated and described herein, various modifications and structural changes may be made therein without departing from the spirit of the invention and within the scope and range of equivalents of the claims.

What is claimed is:

1. A retractable key storage apparatus comprising:

one or more outer cover plates, each of said outer cover plates having a plurality of openings therethrough, and each of said outer cover plates having pivot guides comprised of curved grooves;

each of said pivot guides further comprising first and second lock orifices, each of such orifices located at opposite ends of said curved grooves;

one or more middle plates, each anchoring a plurality of spring-loaded key release button mechanisms adapted for mounting internally stored keys;

a plurality of keys fixedly mounted on said plurality of spring-loaded key release button mechanisms;

one or more key plates which facilitate the mounting of said keys in the apparatus and provide mounting support for said spring-loaded key release button mechanisms;

each of said plurality of spring-loaded key release button mechanisms comprising a tubular retaining pin element having an open end and a closed end, an internal helical spring, and an "L" shaped guide pin protruding therefrom;

wherein said closed end of said tubular retaining pin element protrudes through said opening on said outer cover plate to provide a button;

wherein said helical spring linearly biases said tubular retaining pin element towards said opening on said outer cover plate;

wherein said "L" shaped guide pin engages inside said curved grove of said pivot guide and is adapted to reciprocally travel along said curved grove between said first and second lock orifices;

wherein said helical spring rotationally biases said tubular retaining pin element towards said first lock orifice and opposite said second lock orifice;

wherein each of said spring-loaded key release button mechanisms is in a stowed position when said "L" shaped guide pin is engaged in said first lock orifice and in an open position when said "L" shaped guide pin is engaged in said second lock orifice;

wherein each of said plurality of spring-loaded key release button mechanisms transitions from a stowed position to an open position when said closed end of said tubular retaining element is depressed, said "L" shaped guide pin disengages said first lock orifice, and said helical spring urges said spring-loaded, key release button mechanism to pivot until said "L" shaped guide pin engages said second lock orifice; and wherein each of said plurality of spring-loaded key release button mechanisms transitions from an open position to a stowed position when said closed end of said tubular retaining element is depressed, said "L" shaped guide pin disengages said second lock orifice, and said key mounted on said spring-loaded key release button mechanism is manually urged to pivot until said "L" shaped guide pin engages said second lock orifice.

2. The retractable key storage apparatus according to claim 1, further including a LED or incandescent bulb flashlight, that operates through a separate button accessed from said one or more outer cover plates.

3. The retractable key storage apparatus according to claim 1, further including an adaptor that enables the installation of standard keys on the apparatus.

4. The retractable key storage apparatus according to claim 3, wherein the adaptor includes an adaptor clamp into which a standard key is placed and a standard key ring hole that is aligned with an adaptor hole; wherein the aligned standard key ring hole and the adaptor hole are slid onto said key release button mechanism and onto said "L" shape guide pin, then a nut cap is securely placed on top of the key release button, whereby the nut cap becomes the portion of said spring-loaded key release button mechanism that protrudes through said opening on said outer cover plate to provide a button.

5. The retractable key storage apparatus according to claim 1, which further includes storage and deployment of accessories selected from the group consisting of: USB drives, files, screwdrivers, scissors and openers.

* * * * *